US007369022B2

(12) United States Patent
Sisson et al.

(10) Patent No.: US 7,369,022 B2
(45) Date of Patent: May 6, 2008

(54) AUXILIARY SWITCH SUB-ASSEMBLY AND ELECTRICAL SWITCHING APPARATUS EMPLOYING THE SAME

(75) Inventors: Glen C. Sisson, Monaca, PA (US); Craig A. Rodgers, Butler, PA (US)

(73) Assignee: Eaton Corporation, Cleveland, OH (US)

( * ) Notice: Subject to any disclaimer, the term of this patent is extended or adjusted under 35 U.S.C. 154(b) by 53 days.

(21) Appl. No.: 11/337,331

(22) Filed: Jan. 23, 2006

(65) Prior Publication Data

US 2007/0171011 A1 Jul. 26, 2007

(51) Int. Cl.

| | |
|---|---|
| ***H01H 73/12*** | (2006.01) |
| ***H01H 75/00*** | (2006.01) |
| ***H01H 77/00*** | (2006.01) |
| ***H01H 83/00*** | (2006.01) |

(52) U.S. Cl. ..... 335/17; 335/16; 335/132

(58) Field of Classification Search ..... 335/16, 335/17, 132

See application file for complete search history.

(56) References Cited

U.S. PATENT DOCUMENTS

| | | | | | |
|---|---|---|---|---|---|
| 2,601,484 | A | * | 6/1952 | Wood | 335/16 |
| 3,742,403 | A | * | 6/1973 | Nicol | 335/13 |
| 3,863,042 | A | * | 1/1975 | Nicol | 200/401 |
| 3,955,162 | A | * | 5/1976 | Nicol | 335/17 |
| 4,209,761 | A | * | 6/1980 | Klein et al. | 335/17 |
| 4,297,663 | A | * | 10/1981 | Seymour et al. | 335/20 |
| 4,400,670 | A | * | 8/1983 | Mostosi | 335/6 |
| 4,551,697 | A | * | 11/1985 | Kussy | 335/16 |
| 4,660,009 | A | * | 4/1987 | Wafer et al. | 335/6 |
| 4,679,019 | A | * | 7/1987 | Todaro et al. | 335/172 |
| 4,700,161 | A | * | 10/1987 | Todaro et al. | 335/172 |
| 4,801,906 | A | * | 1/1989 | Morris et al. | 335/17 |
| 4,831,221 | A | * | 5/1989 | Yu et al. | 200/553 |
| 4,849,590 | A | * | 7/1989 | Becker et al. | 218/33 |
| 4,912,439 | A | * | 3/1990 | Nagy et al. | 335/132 |
| 4,926,149 | A | * | 5/1990 | Saens et al. | 335/132 |
| 5,075,658 | A | * | 12/1991 | Lesslie et al. | 335/14 |
| 5,140,115 | A | * | 8/1992 | Morris | 200/308 |
| 5,172,088 | A | * | 12/1992 | Morgan | 335/201 |
| 5,466,903 | A | * | 11/1995 | Faber et al. | 200/400 |
| 5,539,168 | A | * | 7/1996 | Linzenich | 200/303 |
| 5,552,755 | A | * | 9/1996 | Fello et al. | 335/18 |

(Continued)

OTHER PUBLICATIONS

U.S. Appl. No. 11/254,514, filed Oct. 19, 2005, Zindler.

*Primary Examiner*—Elvin Enad
*Assistant Examiner*—Mohamad A Musleh
(74) *Attorney, Agent, or Firm*—Martin J. Moran

(57) ABSTRACT

An auxiliary switch sub-assembly is provided for a telecommunication system circuit breaker including a housing having an opening, separable contacts inside the housing, and an operating mechanism operating the separable contacts between open and closed positions. The operating mechanism comprises an operating handle operable among a first position corresponding to the separable contacts being open and a second position corresponding to the separable contacts being closed. The operating handle has a first end protruding from the opening of the housing, and a second end. The auxiliary switch sub-assembly includes an auxiliary switch including an actuator, and a mount attaching the auxiliary switch to the operating mechanism of the circuit breaker within the housing thereof. The actuator is mechanically actuated by a portion of the second end of the operating handle. An electrical switching apparatus employing an auxiliary switch sub-assembly is also disclosed.

14 Claims, 5 Drawing Sheets

U.S. PATENT DOCUMENTS 5,823,323 A * 10/1998 Seymour et al. ..... 200/308
5,831,500 A * 11/1998 Turner et al. ..... 335/17
5,836,441 A * 11/1998 Scheel et al. ..... 200/17 R
5,907,461 A * 5/1999 Hartzel et al. ..... 361/42
6,040,746 A * 3/2000 Maloney et al. ..... 335/13
6,137,385 A * 10/2000 Conway et al. ..... 335/202
6,217,370 B1 * 4/2001 Scheel et al. ..... 439/483
6,232,855 B1 * 5/2001 Malingowski et al. ..... 335/14
6,232,859 B1 * 5/2001 Christensen et al. ..... 335/132
6,239,395 B1 * 5/2001 Rosen ..... 200/559
6,366,188 B1 * 4/2002 Hein et al. ..... 335/202
6,377,144 B1 * 4/2002 Castonguay et al. ..... 335/202
6,392,512 B1 * 5/2002 Ferree et al. ..... 335/16
6,421,217 B1 * 7/2002 Castonguay et al. ..... 361/115
6,476,337 B2 * 11/2002 Castonguay et al. ..... 200/400
6,559,745 B2 * 5/2003 Yamagata et al. ..... 335/132
6,633,210 B1 10/2003 Fischer et al.
6,724,284 B2 * 4/2004 Simms et al. ..... 335/14
6,803,535 B1 * 10/2004 Whipple et al. ..... 200/308
6,806,800 B1 * 10/2004 Castonguay et al. ..... 335/68
6,864,447 B1 3/2005 Lipsey, II et al.
6,867,670 B2 * 3/2005 McCormick et al. ..... 335/6
6,882,258 B2 * 4/2005 Castonguay et al. ..... 335/132
6,903,636 B2 * 6/2005 Fischer ..... 335/13
7,023,303 B1 * 4/2006 Bogdon et al. ..... 335/6
7,064,636 B1 * 6/2006 Walz et al. ..... 335/18
7,135,945 B2 * 11/2006 Whipple et al. ..... 335/17
7,199,319 B1 * 4/2007 Rodgers et al. ..... 200/330
2004/0032702 A1 * 2/2004 Gibson et al. ..... 361/102
2004/0085167 A1 * 5/2004 McCormick et al. ..... 335/16
2007/0085642 A1 * 4/2007 Rodgers et al. ..... 335/172

* cited by examiner

AUXILIARY SWITCH SUB-ASSEMBLY AND ELECTRICAL SWITCHING APPARATUS EMPLOYING THE SAME

CROSS-REFERENCE TO RELATED APPLICATION

This application is related to commonly assigned, concurrently filed:

U.S. patent application Ser. No. 11/337,330, filed Jan. 23, 2006, entitled "ELECTRICAL SWITCHING APPARATUS AND TERMINAL HOUSING THEREFOR".

BACKGROUND OF THE INVENTION

1. Field of the Invention

The present invention relates generally to auxiliary switches for electric switching apparatus and, more particularly, to auxiliary switch sub-assemblies for electrical switching apparatus. The invention also relates to electrical switching apparatus employing an auxiliary switch sub-assembly.

2. Background Information

Circuit breakers for telecommunication systems are small in comparison with circuit breakers commonly associated with power distribution networks. By way of example, in accordance with one conventionally known telecommunication system circuit breaker design, the circuit breaker measures about 2.5 inches high by about 2.0 inches long by about 0.75 inch thick, when viewed with the operating handle extending horizontally and moving in a vertical arc. While having a reduced size, the telecommunication system circuit breaker must still accommodate the various components (e.g., separable contacts; trip mechanism; operating mechanism) associated with larger circuit breakers.

Electrical switching apparatus, such as the aforementioned circuit breakers, as well as transfer switches, network protectors and the like, are often equipped with auxiliary switches that provide signals indicating certain conditions within the apparatus. For example, such auxiliary switches indicate whether the separable contacts are open or closed and/or whether the device has been tripped open. The signals generated by the switches can be used for communicating the condition to a remote location.

Auxiliary switches are either mechanically actuated usually through physical contact with, or by a linkage to, the operating mechanism that opens and closes the separable contacts, or are of a non-contact variety being actuated by any known or suitable non-contact sensor (e.g., without limitation, Hall effect device; proximity sensor; optical sensor). However, some non-contact auxiliary switch designs are more complex thus undesirably increasing the complexity and associated cost of the circuit breaker. The small size of some electrical switching apparatus, including telecommunication system circuit breakers, provides limited space for mechanical auxiliary switches to be mounted within the apparatus housing. In one prior proposal, such mechanically actuated switches have been housed within their own separate enclosures mounted on the outside of the circuit breaker housing. However, this requires the circuit breaker housing to be modified to include an opening for the mechanical linkage.

There is a need, therefore, for a mechanically actuated auxiliary switch capable of being mounted in the limited space inside the housing of small electrical switching apparatus, such as telecommunication system circuit breakers.

There is, therefore, room for improvement in auxiliary switches.

There is also room for improvement in electrical switching apparatus including auxiliary switches.

There is further room for improvement in circuit breakers, such as telecommunication system circuit breakers, having a reduced size but including an auxiliary switch disposed within the housing of the circuit breaker.

SUMMARY OF THE INVENTION

These needs and others are met by the present invention, which is directed to an auxiliary switch sub-assembly that positions the auxiliary switch within the circuit breaker housing for mechanical actuation by the circuit breaker operating handle upon movement of the operating handle to a predetermined position.

As one aspect of the invention, an electrical switching apparatus comprises: a housing including an opening; separable contacts inside the housing; an operating mechanism structured to open and close the separable contacts, the operating mechanism comprising an operating handle operable among a first position corresponding to the separable contacts being open and a second position corresponding to the separable contacts being closed, the operating handle having a first end protruding from the opening of the housing, and a second end disposed within the housing; and an auxiliary switch sub-assembly comprising: an auxiliary switch including an actuator, and a mount attaching the auxiliary switch to the operating mechanism within the housing. When the operating handle is moved to a predetermined one of the first and second positions, a portion of the second end of the operating handle mechanically engages and actuates the actuator of the auxiliary switch.

The auxiliary switch may further include a body and the mount may comprise a receiving portion securably receiving the body, and an attachment portion coupling the mount and the auxiliary switch therein to the operating mechanism. The body of the auxiliary switch may include at least one opening and the receiving portion of the mount may further comprise at least one protrusion received by the opening in order to secure the auxiliary switch to the mount.

The operating mechanism may further comprise a pin wherein the attachment portion of the mount couples the auxiliary switch to the pin. The attachment portion of the mount may comprise an integral hook extending from the receiving portion of the mount, wherein the integral hook couples the mount to the pin of the operating mechanism. Additionally, the interior of the housing may include a recess corresponding to the mount, wherein the mount is partially disposed within the recess in order to maintain the position of the mount, with respect to the housing.

The second end of the operating handle may comprise a first resilient leg and a second resilient leg wherein the first and second resilient legs extend laterally in opposite directions within the opening of the housing. The first resilient leg may comprise the portion of the second end of the operating handle which engages and mechanically actuates the actuator of the auxiliary switch. The actuator of the auxiliary switch may have an actuated position and a non-actuated position. When the operating handle of the electrical switching apparatus is disposed in the second position, the first resilient leg engages and actuates the actuator to the actuated position thereof.

As another aspect of the invention, an auxiliary switch sub-assembly is provided for an electrical switching apparatus. The electrical switching apparatus includes a housing having an opening and containing separable contacts, and an operating mechanism operating the separable contacts between open and closed positions. The operating mechanism comprises an operating handle operable among a first position corresponding to the separable contacts being open and a second position corresponding to the separable contacts being closed. The operating handle has a first end protruding from the opening of the housing, and a second end. The auxiliary switch sub-assembly comprises: an auxiliary switch including an actuator; and a mount structured to attach the auxiliary switch to the operating mechanism of the electrical switching apparatus within the housing thereof. The actuator of the auxiliary switch is structured to be mechanically actuated by a portion of the second end of the operating handle upon movement of the operating handle to a predetermined one of the first and second positions.

The auxiliary switch may include a housing and the actuator of the auxiliary switch may comprise a lever pivotably coupled to the housing of the auxiliary switch, wherein the second end of the operating handle engages and actuates the lever when the operating handle is disposed in the second position. The mount for attaching the auxiliary switch to the operating mechanism may comprise a single molded piece.

The electrical switching apparatus may be a telecommunication system circuit breaker.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
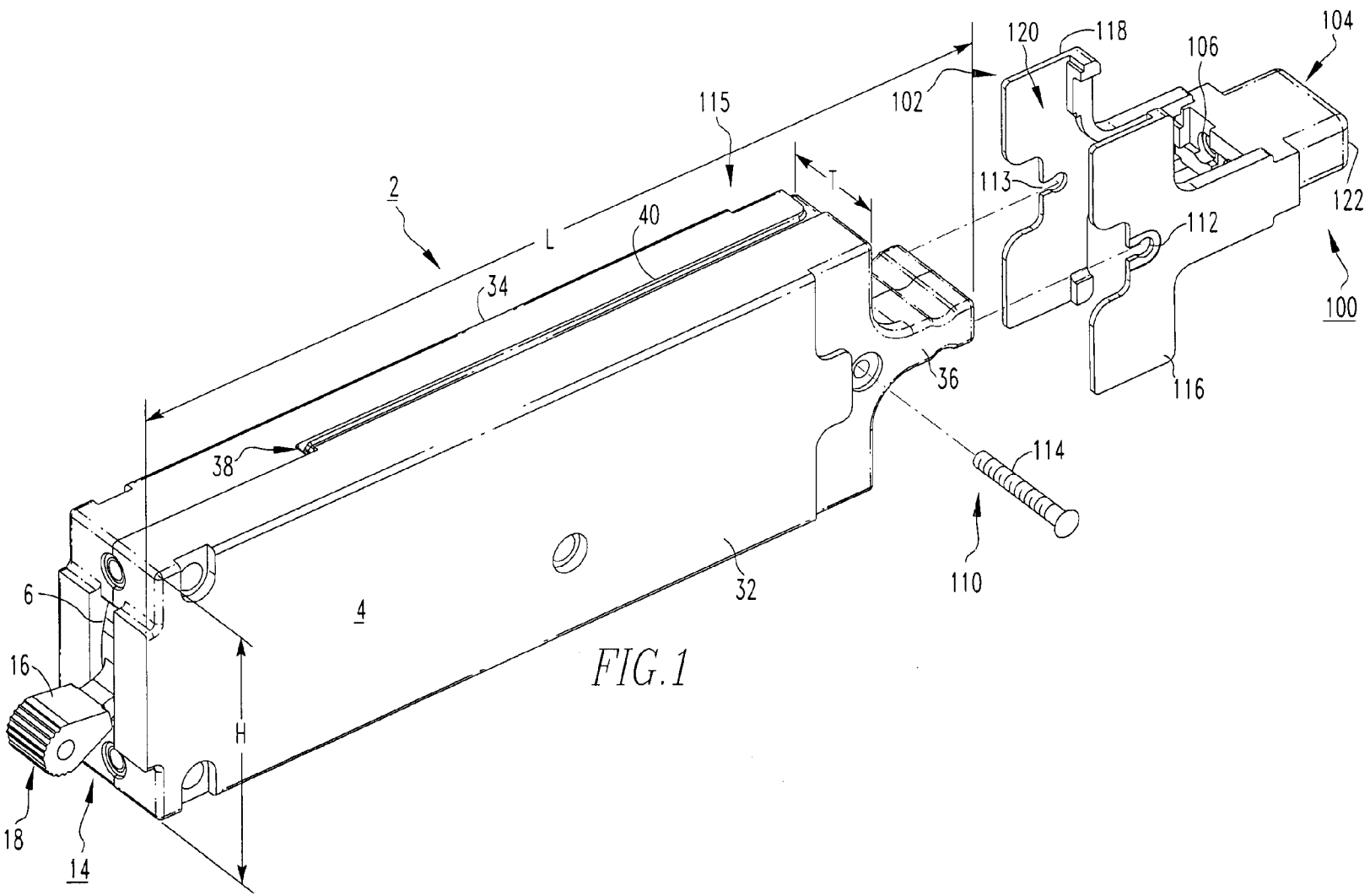
FIG. 1 is an exploded isometric view of a circuit breaker and a terminal housing therefor.

For purposes of illustration, the invention will be described as applied to a telecommunication system circuit breaker, although it will become apparent that the invention could be applied to a variety of circuit breakers for a wide range of applications such as, for example and without limitation, residential or molded case circuit breakers.

Directional phrases used herein, such as, for example, left, right, clockwise, counterclockwise and derivatives thereof, relate to the orientation of the elements shown in the drawings and are not limiting upon the claims unless expressly recited therein.

As employed herein, the term "fastener" refers to any suitable connecting or tightening mechanism expressly including, but not limited to, rivets, screws, bolts and the combinations of bolts and nuts (e.g., without limitation, lock nuts) and bolts, washers and nuts.

As employed herein, the statement that two or more parts are "coupled" together shall mean that the parts are joined together either directly or joined through one or more intermediate parts.

As employed herein, the statement that a part is "electrically interconnected with" one or more other parts shall mean that the parts are directly electrically connected together or are electrically connected together through one or more electrical conductors or generally electrically conductive intermediate parts. Further, as employed herein, the statement that a part is "electrically connected to" one or more other parts shall mean that the parts are directly electrically connected together or are electrically connected together through one or more electrical conductors.

As employed herein, the term "output" refers to any suitable mechanism for delivering an electrical signal, such as, for example and without limitation, the terminals of a micro-switch, which are outputs for delivering the signal generated in response to an actuation of the micro-switch.

As employed herein, the term "number" shall mean one or more than one (i.e., a plurality).

FIG. 1 shows an electrical switching apparatus 2 and terminal housing 100 therefor. In the example of FIG. 1, the electrical switching apparatus is a telecommunication circuit breaker 2 including an enclosure or housing 4 which has a length, represented by the letter "L," between about 5.0 and about 4.0 inches, and more preferably about 4.6 inches. The housing 4 also has a height, represented by the letter "H," of between about 1.75 inches and about 1.0 inch, and more preferably about 1.5 inches, and a thickness, represented by the letter "T," of between about 1.0 inch and about 0.5 inches, and more preferably about 0.75 inches. It will, however, be appreciated that the present invention is applicable to circuit breakers and other electrical switching apparatus having a wide variety of shapes and sizes.

Figure 2:
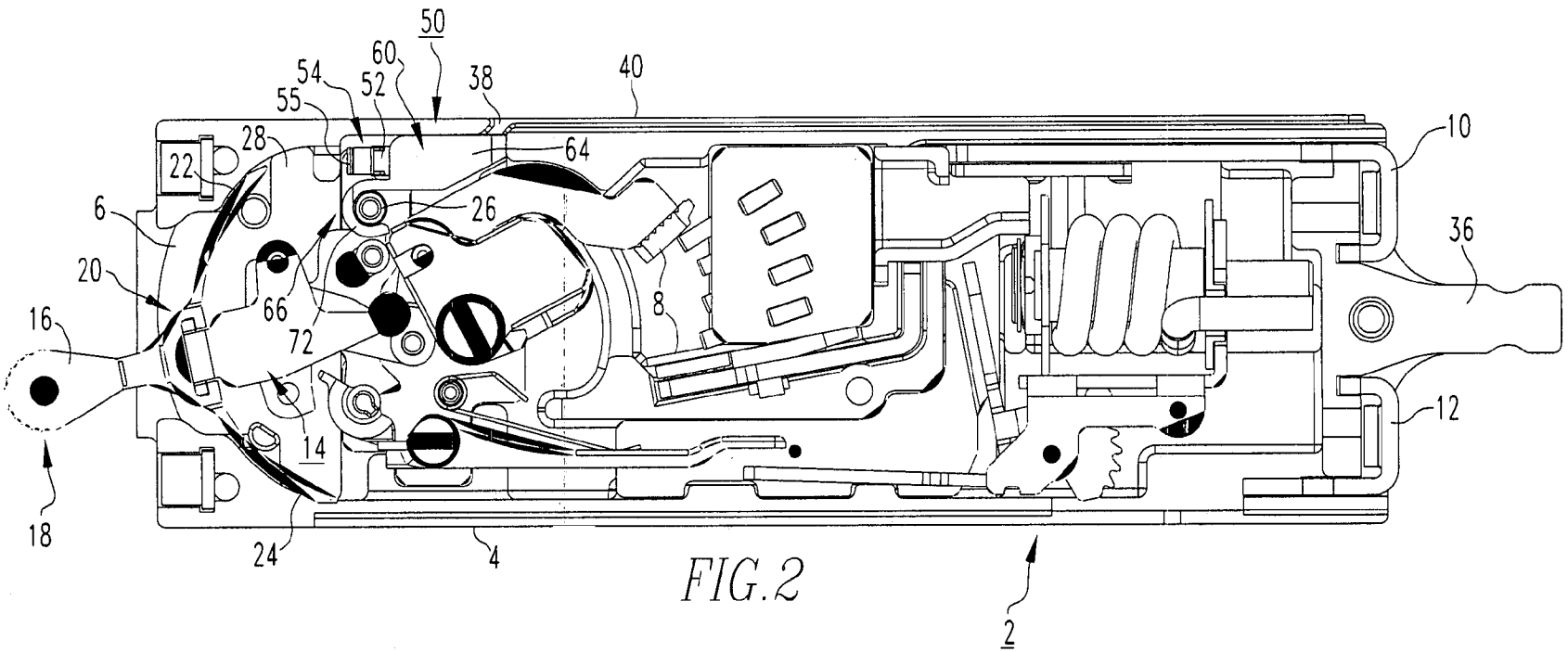
FIG. 2 is a side view of the circuit breaker of FIG. 1 with half of the circuit breaker housing removed to show internal structures including an auxiliary switch sub-assembly in accordance with the present invention.
Figure 5:
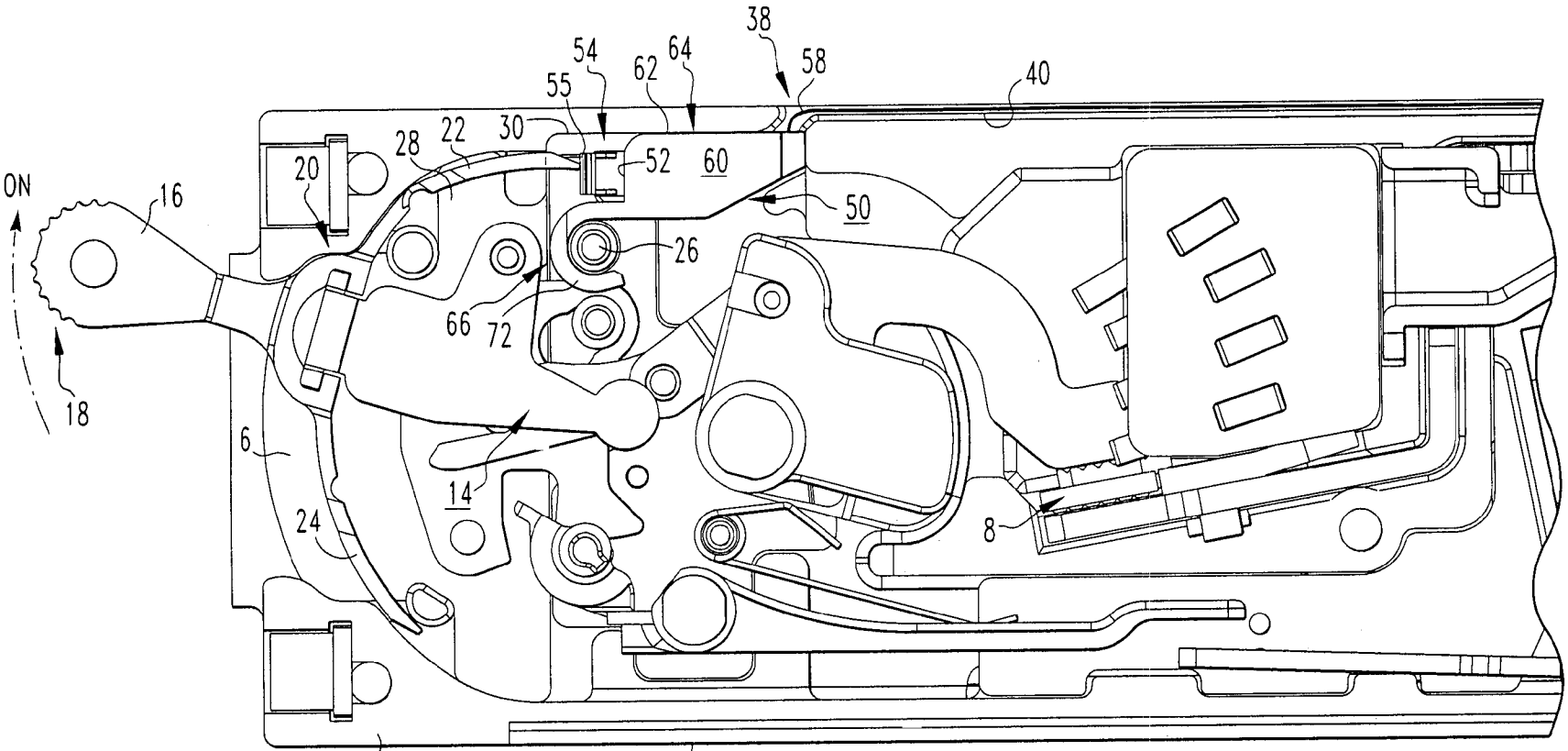
FIG. 5 is a side view of a portion of the circuit breaker and the auxiliary switch sub-assembly of FIG. 2 modified to show the circuit breaker operating handle in the ON position, thereby actuating the auxiliary switch.

Referring to FIGS. 1, 2 and 5, it will be appreciated that, in addition to housing 4 which has an opening 6, the circuit breaker 2 also includes separable contacts 8 (FIGS. 2 and 5) inside the housing 4, line and load terminals 10, 12 (FIG. 2) in electrical communication with the separable contacts 8, and an operating mechanism 14 structured to open and close the separable contacts 8 (FIGS. 2 and 5).

Figure 4:
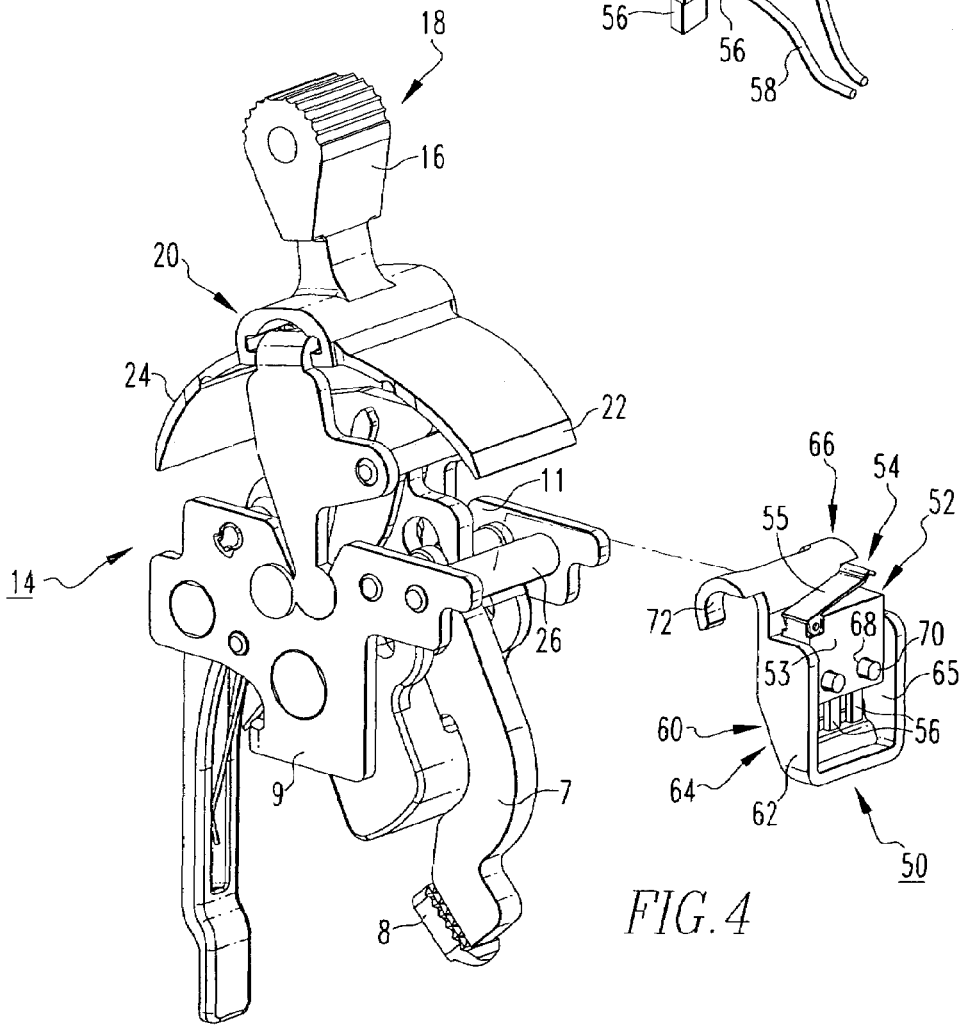
FIG. 4 is an exploded isometric view of the auxiliary switch sub-assembly and circuit breaker operating mechanism of FIG. 2.

The operating mechanism 14, as shown in FIGS. 2, 4 and 5, comprises an operating handle 16 operable among a first position (FIGS. 2 and 4) corresponding to the separable contacts 8 (only one of the contacts 8 (the movable contact) is shown in FIG. 4) being open, and a second position (FIG. 5) corresponding to the separable contacts 8 being closed. The operating handle 16 has a first end 18, which protrudes from the opening 6 of housing 4, and a second end 20 disposed within the housing 4, as shown in FIGS. 2 and 5. In the example shown and described herein, the second end 20 of operating handle 16 comprises a first resilient leg 22 and a second resilient leg 24. The first and second resilient legs 22, 24 extend in opposite directions within the opening 6 of housing 4. In this manner, the resilient legs 22, 24 resist undesired access to the interior 28 of the circuit breaker housing 4.

As best shown in FIG. 4, the operating mechanism 14 generally comprises a plurality of rigid members, including the movable arm 7 to which movable contact 8 is coupled. The rigid members (e.g., 7) interact with the second end 20 of operating handle 16 in order to open and close the separable contacts 8 upon movement of the operating handle 16 to the first open position and the second closed position, respectively. The rigid members are disposed between first and second side plates 9, 11 of the operating mechanism 14, as shown. At least one pin 26 extends between and interconnects the side plates 9, 11.

Referring to FIGS. 2-5, an auxiliary switch sub-assembly 50 in accordance with the invention, will now be discussed. The auxiliary switch sub-assembly 50 includes an auxiliary switch 52 having an actuator 54, and a mount 60 structured to attach the auxiliary switch 52 to the operating mechanism 14 (not shown in FIG. 3) of the circuit breaker 2 (FIGS. 2 and 5). The mount 60 of the exemplary auxiliary switch sub-assembly 50 comprises a receiving portion 64 securably receiving the auxiliary switch 52, and an attachment portion 66, which comprises an integral hook 72 extending from the receiving portion 64 in order to attach the mount 60 to the pin 26 of the operating mechanism 14. In this manner, the auxiliary switch sub-assembly 50 of the invention is directly attached to the operating mechanism 14 of the circuit breaker 2. It will, however, be appreciated that any known or suitable alternative attachment mechanism and/or attachment portion configuration, other than the exemplary integral hook 72, could be employed to attach the mount 60 to the operating mechanism 14. It will further be appreciated that the mount 60 and auxiliary switch 52 coupled thereto could alternatively be attached to the operating mechanism 14 at a location other than pin 26. It will still further be appreciated that while the mount 60 of the auxiliary switch sub-assembly 50 is contemplated as comprising a single molded piece (best shown in FIG. 3), it could alternatively be made from a plurality of separate components joined together.

The receiving portion 64 of mount 60, in the example shown and described herein, comprises a molded receptacle 65 structured to receive the body 62 of the auxiliary switch 52. Additionally, the auxiliary switch body 62 has at least one opening 68, and the receiving portion 64 of the mount 60 includes at least one corresponding protrusion 70 received by the opening 68, in order to secure the auxiliary switch 52 to the mount 60. The exemplary body 62 includes a pair of first and second openings 68, and the receiving portion 64 of mount 60 comprises a pair of first and second posts 70 (best shown in the exploded view of FIG. 3), received by the first and second openings 68, respectively. The first and second posts 70 each further include a plurality of resilient ribs 74 structured to engage a corresponding one of the first and second openings 68 when the first and second posts 70 are respectively disposed therein. In this manner, the auxiliary switch 52 is further secured to mount 60. It will, however, be appreciated that any known or suitable alternative mechanism, other than the posts 70 and ribs 74, could be employed to receive and secure the auxiliary switch 52. Additionally, although the receiving portion 64 is contemplated as comprising a molded receptacle 65, the molded receptacle is not required, and other receiving portion configurations (not shown) could be alternatively employed without departing from the scope of the present invention.

The position of the mount 60 of auxiliary switch sub-assembly 50 and the auxiliary switch 52 coupled thereto, are further maintained by engagement of the mount 60 with the interior 28 of the circuit breaker housing 4, best shown in the example of FIG. 5. More specifically, the housing interior 28 includes a recess 30 corresponding to the mount 60. The mount 60 is partially disposed within the recess 30 thereby maintaining the mount's position with respect to the housing 4, as well as with respect to the operating mechanism 14. In this manner, the exemplary auxiliary switch sub-assembly 50 is mounted in a stationary position within the interior 28 of the circuit breaker housing 4. This permits the actuator 54 of the auxiliary switch 52 to be readily and consistently actuated by a portion of the second end 20 of operating handle 16. It will, however, be appreciated that engagement of the interior 28 by mount 60 is not required. It will further be appreciated that any suitable alternative engagement arrangement between mount 60 and housing 4 could be employed within the scope of the invention. Operation of the auxiliary switch 52 will now be described.

Generally, when the operating handle 16 is moved to a predetermined one of the first and second positions, as previously described, a portion of the second end 20 of the operating handle 16 mechanically engages and actuates the actuator 54 of auxiliary switch 52. More specifically, the second end 20 of the operating handle 16 includes the aforementioned first and second resilient legs 22, 24, and the portion of the second end 20 of operating handle 16 which engages and actuates the actuator 54 of auxiliary switch 52, is the first resilient leg 22. Accordingly, as shown in FIG. 5, when the operating handle 16 is moved to the second position (i.e., pivoted clockwise with respect to FIG. 5), which corresponds to the ON position of the circuit breaker 2 in which the separable contacts 8 are closed, the first resilient leg 22 engages and actuates actuator 54 of the auxiliary switch 52. Accordingly, the auxiliary switch 52 has a non-actuated position, shown in FIGS. 2-4, and the actuated position of FIG. 5. In the example shown and described herein, the actuator 54 comprises a lever 55 which is pivotably coupled to the housing 53 of the auxiliary switch 52. The first resilient leg 22 engages and actuates (i.e., pivots downward with respect to FIG. 3) the lever 55 when the operating handle 16 is disposed in the second, ON position of FIG. 5. It will, however, be appreciated that any known or suitable auxiliary switch and actuator therefor, could be employed in accordance with the present invention.

The aforementioned auxiliary switch terminal housing 100, which can be readily employed with any known or suitable auxiliary switch, including the auxiliary switch sub-assembly 50 described hereinabove, will now be described in further detail.

Figure 3:
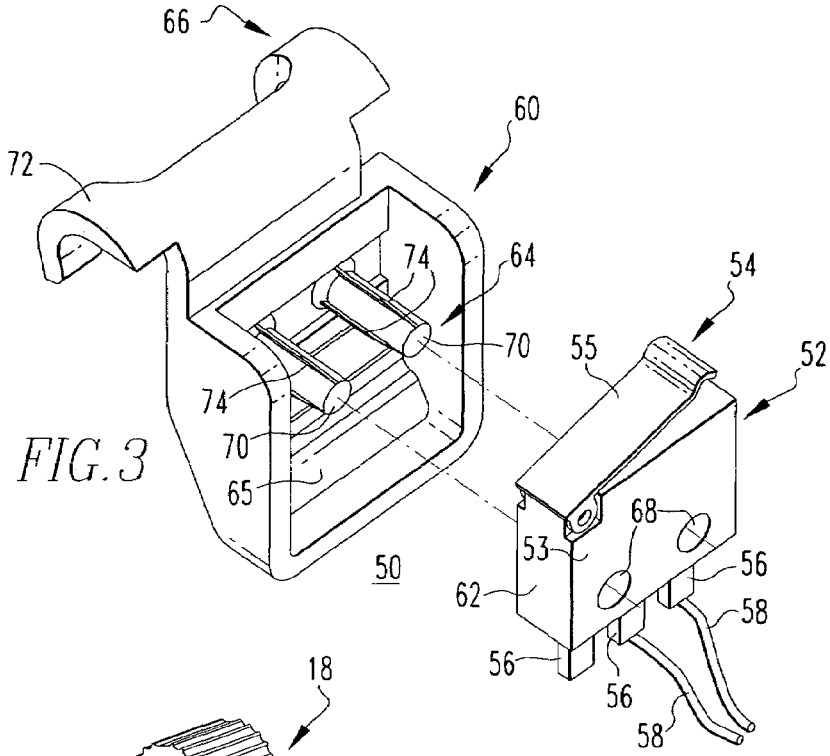
FIG. 3 is an exploded isometric view of the auxiliary switch sub-assembly of FIG. 2.
Figure 6:
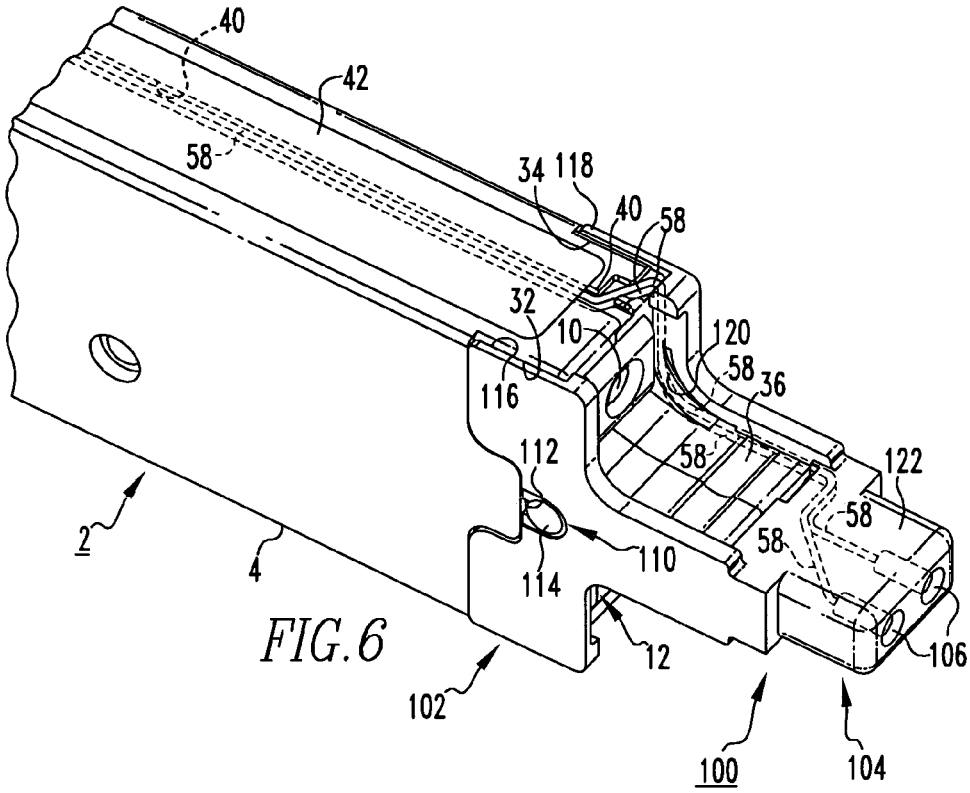
FIG. 6 is an assembled isometric view of a portion of the circuit breaker and the terminal housing of FIG. 1.

Specifically, as shown in FIG. 3, the auxiliary switch 52 includes a plurality of outputs 56 (three outputs 56 are shown in FIG. 3, a pair of outer outputs corresponding to the auxiliary switch being normally open and normally closed, respectively, and a central common output disposed therebetween), and a plurality of conductors 58 (e.g., without limitation, electrical wires) which are electrically interconnected with the outputs 56. In FIG. 3, a pair of conductors 58 are electrically connected at their first ends to the central common output 56 and one of the normally open and normally closed outputs 56 of the auxiliary switch 52. The opposite ends are electrically connected to a pair of terminals 106 in the terminal housing 100, as shown in hidden line drawing in FIG. 6. More specifically, referring to FIGS. 1, 2 and 5, the circuit breaker housing 4 further includes an opening 38 adjacent the auxiliary switch 52 which is disposed therein, and a channel 40 extends from the opening 38 toward the line and load terminals 10, 12 (FIGS. 2 and 6). The conductors 58 extend from the auxiliary switch 52 (FIG. 3) within the housing 4, through the opening 38 and into the channel 40, as shown in FIG. 5, and through the channel 40 into the auxiliary switch terminal housing 100, as shown in FIG. 6. The housing 4 of the circuit breaker 2 optionally further includes a cover 42 which substantially covers the channel 40 and conductors 58 disposed therein, as shown in FIG. 6. It will also be appreciated that the conductors 58 could alternatively be routed in any suitable manner within the housing 4, internally (not shown).

The auxiliary switch terminal housing 100 includes a first portion 102 structured to be coupled to the circuit breaker housing 4 proximate the line and load terminals 10, 12, thereof, and a second portion 104 distal from the first portion 102 and including terminals 106. A fastening mechanism 10 is structured to fasten the terminal housing 100 to the circuit breaker 2, as shown in FIGS. 1 and 6. Specifically, the first portion 102 of the terminal housing 100 includes at least one aperture 112, 113, and the fastening mechanism 110 includes at least one fastener 114, 115 (FIG. 1). In the example shown and described herein, the circuit breaker 2 includes first and second sides 32, 34 (FIGS. 1 and 6), the first portion 102 of the terminal housing 100 includes first and second sides 116, 118 structured to engage the first and second opposing sides 32, 34, and the at least one aperture 112, 113 comprises a first aperture 112 in the first side 116 of the first portion 102, and a second aperture 113 in the second side 118 of first portion 102. A pair of first and second fasteners, such as, for example and without limitation, the rivets 114, 115 (shown in FIG. 1; one rivet 114 is also shown in FIG. 6), are inserted through the first and second apertures 112, 113, respectively, and fastened to secure the terminal housing 100 to the circuit breaker 2. In this manner, the first and second sides 116, 118 of terminal housing 100 are spaced apart from one another in order that the line and load terminals 10, 12 of circuit breaker 2 are generally disposed therebetween.

The second portion 104 of the terminal housing 100 interconnects the first and second sides 116, 118 of the first portion 102 of the terminal housing 100. Thus, the first and second sides 116, 118 of first portion 102 extend from the second portion 104 and are generally parallel with respect to one another, as shown, for example in FIG. 6. Accordingly, when the auxiliary switch terminal housing 100 is coupled to the circuit breaker housing 4, the mounting foot 36, which extends from the circuit breaker housing 4 between the line and load terminals 10, 12 thereof, is generally disposed within the auxiliary switch terminal housing 100 between the first and second sides 116, 118 thereof (best shown in FIG. 6).

Figure 7:
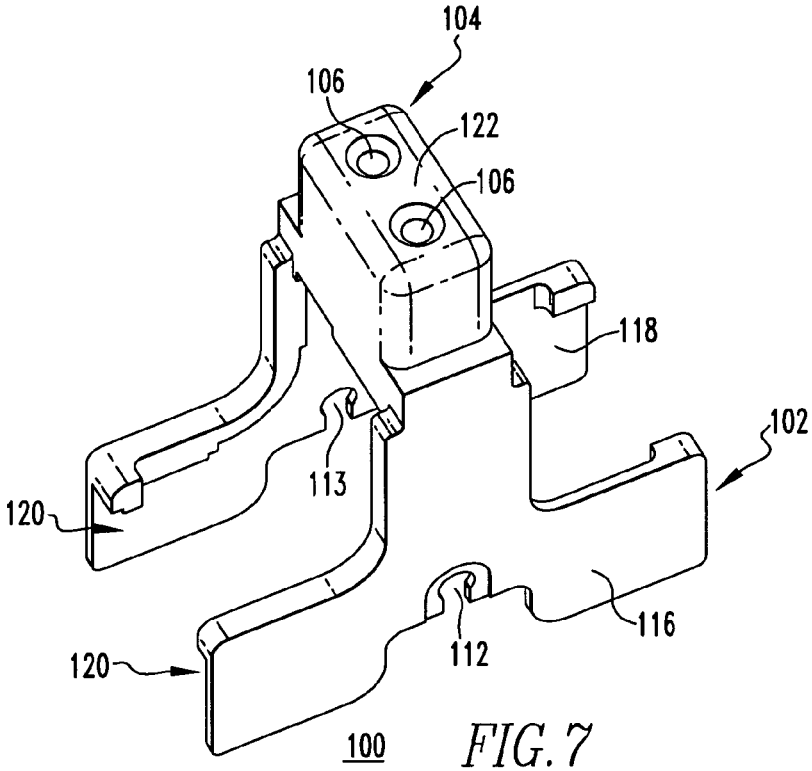
FIG. 7 is an isometric view of the terminal housing of FIG. 1.

Continuing to refer to FIG. 6, it will be appreciated that the aforementioned arrangement provides a passageway 120 between at least one of the first and second sides 116, 118 of the terminal housing 100 and the corresponding one of the first and second sides 32, 34 of the circuit breaker housing 4. As shown, the passageway 120 receives and protects the conductors or electrical wires 58 (partially shown in hidden line drawing in FIG. 6) as they extend from the channel 40 and between mounting foot 36 and second side 118 toward their electrical interconnection with terminals 106. The exemplary second portion 104 comprises a plug-in connector 122 which is structured to readily electrically interconnect with a corresponding connector (not shown) of a wide variety of known or suitable electrical apparatus (not shown). It will be appreciated that although the plug-in connector 122 shown in the examples of FIGS. 1, 6 and 7 is a male connector having two terminals 106, that any known or suitable alternative connector configuration (e.g., without limitation, a female connector (not shown)) having any suitable number of terminals, could be alternatively employed. It will further be appreciated that any suitable number and type of conductors, other than the pair of electrical wires 58 shown, could be employed and routed from the auxiliary switch 52 (FIGS. 3 and 5) to the terminals (e.g., 106) of the auxiliary switch terminal housing 100, in any suitable manner. For example and without limitation, the electrical wires 58 could diverge (not shown) at the exit of the channel 40 in order that first and second wires are disposed in first and second separate passageways (only first passageway 120 is shown in FIG. 6) on opposite sides, respectively, of the mounting foot 36 of circuit breaker 2.

Accordingly, the present invention provides an auxiliary switch sub-assembly capable of being mounted within small electrical switching apparatus, such as, for example and without limitation, telecommunication system circuit breakers, wherein the auxiliary switch 52 is mechanically actuated by the operating handle 16 of the circuit breaker 2.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An electrical switching apparatus comprising:

a housing including an opening;

separable contacts inside said housing;

an operating mechanism structured to open and close said separable contacts, said operating mechanism comprising an operating handle operable among a first position corresponding to said separable contacts being open and a second position corresponding to said separable contacts being closed, said operating handle having a first end protruding from the opening of said housing, and a second end disposed within said housing;

an auxiliary switch sub-assembly comprising:

an auxiliary switch including an actuator, a mount attaching said auxiliary switch to said operating mechanism within said housing;

wherein when said operating handle is moved to a predetermined one of said first and second positions, a portion of the second end of said operating handle mechanically engages and actuates said actuator of said auxiliary switch;

wherein said portion of the second end of said operating handle is engageable with said actuator directly, without requiring a number of components between said portion and said actuator; and wherein said auxiliary switch further includes a body; and wherein said mount comprises a receiving portion securably receiving said body, and an attachment portion attaching said mount and coupling said auxiliary switch therein to said operating mechanism.

2. The electrical switching apparatus of claim 1 wherein said body of said auxiliary switch includes at least one opening; and wherein said receiving portion of said mount further comprises at least one protrusion received by said at least one opening of said body in order to secure said auxiliary switch to said mount.

3. The electrical switching apparatus of claim 1 wherein said operating mechanism further comprises a pin; and wherein said attachment portion of said mount couples said auxiliary switch to said pin of said operating mechanism.

4. The electrical switching apparatus of claim 3 wherein said attachment portion of said mount comprises an integral hook extending from said receiving portion of said mount; and wherein said integral hook couples said mount to said pin of said operating mechanism.

5. An electrical switching apparatus comprising:

a housing including an opening;

separable contacts inside said housing;

an operating mechanism structured to open and close said separable contacts, said operating mechanism comprising an operating handle operable among a first position corresponding to said separable contacts being open and a second position corresponding to said separable contacts being closed, said operating handle having a first end protruding from the opening of said housing, and a second end disposed within said housing;

an auxiliary switch sub-assembly comprising:

an auxiliary switch including an actuator, a mount attaching said auxiliary switch to said operating mechanism within said housing;

wherein when said operating handle is moved to a predetermined one of said first and second positions, a portion of the second end of said operating handle mechanically engages and actuates said actuator of said auxiliary switch;

wherein said portion of the second end of said operating handle is engageable with said actuator directly, without requiring a number of components between said portion and said actuator; and wherein the second end of said operating handle comprises a first resilient leg and a second resilient leg; wherein said first and second resilient legs extend laterally in opposite directions within the opening of said housing; and wherein said first resilient leg of said operating handle comprises said portion of the second end of said operating handle which engages and mechanically actuates said actuator of said auxiliary switch.

6. The electrical switching apparatus of claim 5 wherein said actuator of said auxiliary switch has an actuated position and a non-actuated position; and wherein when said operating handle of said electrical switching apparatus is disposed in said second position, said first resilient leg engages and actuates said actuator to the actuated position thereof.

7. An auxiliary switch sub-assembly for an electrical switching apparatus including a housing having an opening and containing separable contacts, and an operating mechanism operating said separable contacts between open and closed positions, said operating mechanism comprising an operating handle operable among a first position corresponding to said separable contacts being open and a second position corresponding to said separable contacts being closed, said operating handle having a first end protruding from the opening of said housing, and a second end, said auxiliary switch sub-assembly comprising:

an auxiliary switch including an actuator;

a mount structured to attach said auxiliary switch to said operating mechanism of said electrical switching apparatus within said housing thereof;

wherein said actuator of said auxiliary switch is structured to be mechanically actuated by a portion of the second end of said operating handle upon movement of said operating handle to a predetermined one of said first and second positions;

wherein said actuator is structured to be engaged by said portion of the second end of said operating handle directly, without requiring a number of components between said portion and said actuator; and wherein said mount comprises a receiving portion for securably receiving said auxiliary switch, and an attachment portion structured to be attached to said operating mechanism.

8. The auxiliary switch sub-assembly of claim 7 wherein said auxiliary switch further includes a body having at least one opening; and wherein said receiving portion of said mount includes at least one protrusion received by said at least one opening of said body in order to secure said auxiliary switch to said mount.

9. The auxiliary switch sub-assembly of claim 8 wherein said at least one opening is a pair of first and second openings; and wherein said at least one protrusion is a pair of first and second posts received by said first and second openings, respectively.

10. The auxiliary switch sub-assembly of claim 9 wherein each of said first and second posts includes a plurality of resilient ribs structured to engage a corresponding one of said first and second openings when said first and second posts are respectively disposed therein, thereby further securing said auxiliary switch to said mount.

11. The auxiliary switch sub-assembly of claim 7 wherein said auxiliary switch includes a body; and wherein said receiving portion of said mount further comprises a molded receptacle structured to receive said body.

12. The auxiliary switch sub-assembly of claim 7 wherein said operating mechanism of said electrical switching apparatus includes a pin; wherein said attachment portion of said mount comprises an integral book extending from said receiving portion; and wherein said integral hook is structured to couple said mount to said pin of said operating mechanism.

13. An auxiliary switch sub-assembly for an electrical switching apparatus including a housing having an opening and containing separable contacts, and an operating mechanism operating said separable contacts between open and closed positions, said operating mechanism comprising an operating handle operable among a first position corresponding to said separable contacts being open and a second position corresponding to said separable contacts being closed, said operating handle having a first end protruding from the opening of said housing, and a second end, said auxiliary switch sub-assembly comprising:

an auxiliary switch including an actuator;

a mount structured to attach said auxiliary switch to said operating mechanism of said electrical switching apparatus within said housing thereof;

wherein said actuator of said auxiliary switch is structured to be mechanically actuated by a portion of the second end of said operating handle upon movement of said operating handle to a predetermined one of said first and second positions;

wherein said actuator is structured to be engaged by said portion of the second end of said operating handle directly, without requiring a number of components between said portion and said actuator; and wherein said mount comprises a single molded piece.

14. An auxiliary switch sub-assembly for an electrical switching apparatus including a housing having an opening and containing separable contacts, and an operating mechanism operating said separable contacts between open and closed positions, said operating mechanism comprising an operating handle operable among a first position corresponding to said separable contacts being open and a second position corresponding to said separable contacts being closed, said operating handle having a first end protruding from the opening of said housing, and a second end, said auxiliary switch sub-assembly comprising:

an auxiliary switch including an actuator;

a mount structured to attach said auxiliary switch to said operating mechanism of said electrical switching apparatus within said housing thereof;

wherein said actuator of said auxiliary switch is structured to be mechanically actuated by a portion of the second end of said operating handle upon movement of said operating handle to a predetermined one of said first and second positions;

wherein said actuator is structured to be engaged by said portion of the second end of said operating handle directly, without requiring a number of components between said portion and said actuator; and wherein the second end of said operating handle comprises a first resilient leg and a second resilient leg, said first and second resilient legs extending laterally in opposite directions within the opening of said housing; and wherein when said operating handle is disposed in said predetermined one of said first and second positions, the first resilient leg engages and mechanically actuates said actuator of said auxiliary switch.

* * * * *